US008090127B2

(12) United States Patent
Boretzki et al.

(10) Patent No.: US 8,090,127 B2
(45) Date of Patent: Jan. 3, 2012

(54) METHOD FOR MANUFACTURING A FITTED HEARING DEVICE

(75) Inventors: Michael Boretzki, Ruti (CH); Manfred Duerst, Uster (CH); Elmar Fichtl, Oetwil am See (CH)

(73) Assignee: Phonak AG, Stafa (CH)

( * ) Notice: Subject to any disclaimer, the term of this patent is extended or adjusted under 35 U.S.C. 154(b) by 1086 days.

(21) Appl. No.: 11/933,465

(22) Filed: Nov. 1, 2007

(65) Prior Publication Data

US 2008/0089540 A1 Apr. 17, 2008

Related U.S. Application Data

(63) Continuation of application No. 11/579,176, filed as application No. PCT/CH2005/000701 on Nov. 25, 2005.

(51) Int. Cl.
*H04R 25/00* (2006.01)

(52) U.S. Cl. ..... 381/312; 381/322; 381/328

(58) Field of Classification Search ..... 381/60, 381/312, 314–322, 328
See application file for complete search history.

(56) References Cited

U.S. PATENT DOCUMENTS 7,058,182 B2 * 6/2006 Kates ..... 381/60

FOREIGN PATENT DOCUMENTS

| | | | |
|---|---|---|---|
| EP | 0516808 | B1 | 12/1992 |
| EP | 1246505 | A1 | 10/2002 |
| EP | 1256260 | B1 | 11/2002 |
| EP | 1 345 470 | A2 | 9/2003 |
| EP | 1414271 | A2 | 4/2004 |
| EP | 1675430 | A1 | 6/2006 |
| WO | 92/11737 | A1 | 7/1992 |
| WO | 9948323 | A2 | 9/1999 |
| WO | 9953742 | A2 | 10/1999 |
| WO | 0022874 | A2 | 4/2000 |
| WO | 02/071794 | A1 | 9/2002 |
| WO | 2004/057916 | A2 | 7/2004 |

OTHER PUBLICATIONS

European Office action for 05 804 258.1-1224 dated Jul. 28, 2009.

* cited by examiner

*Primary Examiner* — Suhan Ni
(74) *Attorney, Agent, or Firm* — Pearne & Gordon LLP

(57) ABSTRACT

A method for: Adjusting a hearing device in a computer-aided manner towards the needs of an individual, and storing a workflow data of the adjusting. The workflow data may include adjusting steps, fitting operations, timing of performing of the adjusting steps or fitting operations, or a time sequence of the adjusting steps or fitting operations. The adjusting can be performed in dependency of the workflow data of adjusting hearing devices, as performed and stored previously.

11 Claims, 3 Drawing Sheets

METHOD FOR MANUFACTURING A FITTED HEARING DEVICE

CROSS-REFERENCE TO RELATED APPLICATIONS

This application is a continuation of U.S. application Ser. No. 11/579,176 Oct. 30, 2006, which is the national stage of PCT application number PCT/CH2005/000701 Nov. 25, 2005, both of which are incorporated herein by reference.

BACKGROUND OF THE INVENTION

In methods or processes with respect to hearing device adjustments, the workflow of an adjusting operation i.e. sequence of adjusting steps, the adjusting steps themselves and the timing of performing these steps, are not stored. A particular adjusting or fitting operation of a hearing device is performed independent of previous adjustments or fittings of the hearing device. Thereby, most generically, the expertise from previous adjustments is lost after the adjustment is performed, particularly if subsequent adjustments are performed by different individuals, i.e. experts, at different locations. Although, adjustments and fittings of a hearing device are often associated with fitting mechanical characteristics of the respective hearing devices e.g. shape of the shell, surface characteristics of the shell etc., they may also concern adjusting signal-processing of the respective hearing device.

BRIEF SUMMARY OF THE INVENTION

The present invention concerns a method for manufacturing a hearing device which is fitted to needs of an individual, and further concerns a method for fitting a hearing device to the needs of an individual and still further concerns a fitting system for hearing devices.

We understand throughout the present description and claims under the term "hearing device" a device which acts on acoustical perception of an individual. Thereby, such "acting" may be improving perception of acoustical signals but may also be reduction of perception e.g. if the hearing device is a hearing protection device.

The hearing device may be a hearing device worn completely in the ear channel, a CIC, an in-the-ear hearing device or an outside-the-ear hearing device or even an implantable hearing device. The hearing device may be provided for therapeutical purposes, as a hearing aid device, to improve acoustical perception of a hearing-impaired person or may be a hearing help device for normal hearing persons so as to improve their acoustical perception e.g. selectively in specific acoustical surroundings, as in noisy surrounding where selectively a speaker should be well-perceived.

Hearing devices may be adapted specifically to the needs of one individual which shall wear such device.

Generically, adaptation of a hearing device to the needs of an individual is addressed under the term of "fitting" the hearing device. Fitting of a hearing device is e.g. performed so as to accurately adapt its outer shape to the shape and characteristics of an application area whereat the specific individual will wear such device. Fitting, in this case, addresses adjusting the shape or mechanical characteristic or surface characteristic of the outer casing or shell of the hearing device. In a different sense fitting a hearing device addresses adjusting signal-processing in the hearing device. As perfectly known to the skilled artisan modern hearing devices provide for highly efficient processing of input-acoustical signals converted to electrical signals to output-mechanical, thereby e.g. acoustical signals to the individual whereby such signal-processing is performed digitally and offers a huge variety of adjustable parameters. Often signal-processing is performed according to different programs according to which the signal-processing is adapted to improve or, in the sense addressed above, to reduce selectively individual's perception in specific acoustical surroundings. Fitting a hearing device thereby addresses adjusting one or more than one of the signal-processing governing parameters and may include updating of hearing device processing software or even exchange of some units within the hearing device which are effective upon the overall signal-processing as e.g. microphones.

The present invention most generically departs from the recognition that the important manufacturing step for hearing devices which are fitted to respective individuals, namely the fitting step is performed e.g. by respective experts, primarily based on their experience and skill. The high amount of experience present in the overall expertise commonly is hardly exploited to improve momentary or future fitting processes. Departing from this recognition it is an object of the present invention to improve on one hand manufacturing of fitted hearing devices, on the other hand to improve fitting methods per se and lastly to provide a fitting system which offers improved fitting ability. This is achieved by a method for manufacturing a hearing device which is fitted to needs of an individual which comprises

- providing a hearing device;
- adjusting the hearing device in a computer-aided manner toward the needs of the individual;
- storing data which identifies workflow of the adjusting and
- performing the adjusting in dependency of stored workflows resulting from previously adjusting hearing devices.

Under a second aspect there is provided a method for fitting a hearing device to needs of an individual which comprises

- adjusting the hearing device in a computer-aided manner towards the needs of the individual;
- storing data identifying workflow of the adjusting and
- performing the adjusting in dependency of stored workflows resulting from previously adjusting hearing devices.

Thereby under both aspects the workflow of an adjusting operation i.e. sequence of adjusting steps, the adjusting steps themselves and the timing of performing these steps, is monitored and stored. A momentary performed adjusting or fitting of a hearing device is performed in dependency of stored workflows, stored during previous adjusting—i.e. fitting processes of hearing devices. Thereby, most generically, the expertise which has accumulated throughout previous fitting operations which operations had been performed e.g. by different experts at different locations is exploited. In spite of the fact that the methods according to the present invention may be applied for fitting mechanical characteristics of the respective hearing devices e.g. shape of the shell, surface characteristics of the shell etc. in one embodiment of the methods adjusting comprises adjusting signal-processing at the respective hearing devices.

DEFINITION

We understand throughout the present description and claims under an "unfitted" hearing device a hearing device which does not yet satisfy or completely satisfy the needs of an individual which shall wear the addressed hearing device. Such needs may be comfort or aesthetic needs or "audiologic" needs.

We understand under "audiologic" needs of an individual needs with respect to the manner with which acoustical signals impinging on the hearing device are perceived by the individual wearing the hearing device. In analogy we understand under "audiological" characteristics of the hearing device the signal-processing characteristics by which the addressed impinging acoustical signals are processed and transmitted to the individual as mechanical, e.g. again acoustical, signals output from the hearing device.

We understand throughout the present description and claims under an action or method step which is performed "computer-aided", such a step which is performed by an expert under the lead or advice of a computer up to such step being completely automatically performed without interaction of an expert.

We understand under "adjusting" a hearing device, "fitting" such device and vice-versa.

We understand under "workflow" of an adjusting process, the image of such process.

As mentioned above one feature of the methods according to the present invention comprises storing data which identifies the workflow of adjusting. Such data for identifying the workflows comprise, as was addressed, time-sequence, adjusting steps and timing of such steps i.e. rather technical data. Nevertheless, rather un-technical conditions under which a fitting process is performed may largely influence the adjusting or fitting operation. Thus, in one embodiment of the methods according to the present invention additionally to "technical" workflow identifying data, data are stored and assigned to the respectively stored workflows which additionally specify such workflow. Such data are at least of one of the following categories:

data which characterizes the person and/or the personality of the expert who did or who does perform the adjusting. Thereby the characteristics of such expert as his endurance, his momentary stress-level, his experience, sex, age, preferred language, etc. may be entered;

data characterizing the individual which is involved in the respective adjusting process, which again might be data identifying experience with hearing devices, language etc., very much in analogy to data identifying the expert;

data which identifies the software and/or the software update which is or which was used for the respective computer-aided adjusting;

data which identifies the hardware which was or is used for the addressed computer-aided adjusting steps;

the hardware of the hearing device involved;

data identifying the software or software update as applied to the hearing device involved;

conditions whereupon the adjusting is performed which may comprise e.g. acoustical stimuli applied, in-situ adjustment or ex-situ adjustment, comfort and equipment at the fitting place etc.

quality estimates for the addressed adjustment operation.

With respect to quality estimates and as will be addressed later it may be an important feature to consider whether an adjusting or fitting process has satisfied or not the individual involved or could be performed computer-aided in a manner which satisfies or does not satisfy the expert involved with the adjusting operation.

In an embodiment according to the addressed methods the dependency of a presently performed adjusting operation or of a future adjusting operation from workflows as previously stored, is established via computer-aided evaluation of the addressed stored workflows. Thereby we understand throughout the present description and claims under the addressed term of "dependency" an influence which is exerted on a momentary or future adjusting process by previously performed adjusting processes the workflows thereof having been stored.

Under consideration of the wide understanding of "dependency" in a most generic approach the dependency may be established by comprising at least one consulting and/or training an expert performing the adjusting in dependency of at least a part of the stored workflows. If e.g. for the same fitting process the stored workflows reveal that some experts do perform such fitting process in much shorter time and e.g. to complete satisfaction of the individual than others, then the addressed other experts will be trained which will result in that these experts will perform future fitting processes in an improved manner which thus occurs in dependency of previously stored workflows.

updating or rebuilding software for computer-aided adjusting in dependency of at least a part of the stored workflows. If e.g. some of the experts complain about computer support when performing some of the fitting processes, evaluation of the workflows will reveal such complaints and may lead to updating fitting software. Thus future fitting processes will be performed based on updated fitting software, which is the result of previously stored fitting process workflows making the momentary or a future fitting processes dependent, under a generic aspect, from previously stored fitting process workflows.

optimizing workflow for adjusting in dependency of at least a part of the stored workflows. If, as an example, one expert performs a fitting process in half the time than others to complete satisfaction of the involved individuals, evaluation of the stored workflows may e.g. reveal that such experts started adjusting signal-processing by an adjusting different parameter initially than the other experts did. Evaluation will recognize such difference which will lead to other experts who perform the addressed fitting process momentarily or in future being advised or led through the computer-aided fitting process according to the more optimal workflow as recognized.

Workflows which are evaluated as optimum, may be stored or marked as momentary optimum workflows which may dynamically be updated. This leads to a self-teaching or self-optimizing expert databank for momentary of future fitting processes. Thus in one embodiment of the addressed methods according to the present invention results of evaluating the stored workflows are stored and applied as a basis for future evaluating purposes.

In a further embodiment of the addressed methods the stored workflows are stored in at least one databank.

In a further embodiment of the addressed methods the addressed dependency is selected in dependency of an adjusting or fitting process which is to be performed.

Thereby as an example, if a fitting process which is directed on adjusting the shape of a hearing device shell is to be performed, it will be made dependent on previously performed fitting processes also involving shape adjustment and will not be made dependent from previously performed adjusting processes which exclusively address signal-processing. Thus an adjusting to be performed is identified and may govern a group of stored workflows from which the adjusting as momentary to be performed shall be made dependent.

The fitting system according to the present invention for fitting hearing devices towards needs of respective individuals comprises a fitting computer, a workflow databank a data input thereof being operationally connectable to the output of the fitting computer and wherein the fitting computer generates at the addressed output data which identify a fitting operation workflow as performed. The databank has an output which is operationally connected to an evaluation computer which may be the fitting computer. The output of the evaluation computer is operationally connectable to a computer/man interface adjacent to the fitting computer or—if separate from the fitting computer—to the fitting computer itself. Thereby the operational connection between the output of the evaluation computer and such interface and/or fitting computer may be very indirect thus e.g. via a software manufacturer which, caused by the result at the output of the evaluation computer, updates software at the addressed fitting computer. We refer in this context to the above comment with respect to broad understanding of the "dependency" and "evaluation" terms. As addressed, the evaluation computer may be realized in or by the fitting computer itself.

Attention is drawn to the US patent application US 2004/0 208 331 wherein during one single fitting process previously performed adjusting steps do influence future fitting steps. It is noted the difference to the present invention where previously performed fitting processes and their workflows do influence later fitting processes.

BRIEF DESCRIPTION OF SEVERAL VIEWS OF THE DRAWINGS

The description of the present invention up to now already opens to the skilled artisan a wide range of possible realization forms and applications. Nevertheless, the invention shall now be further exemplified with the help of figures. The figures show.

DETAILED DESCRIPTION OF THE INVENTION

Figure 1:
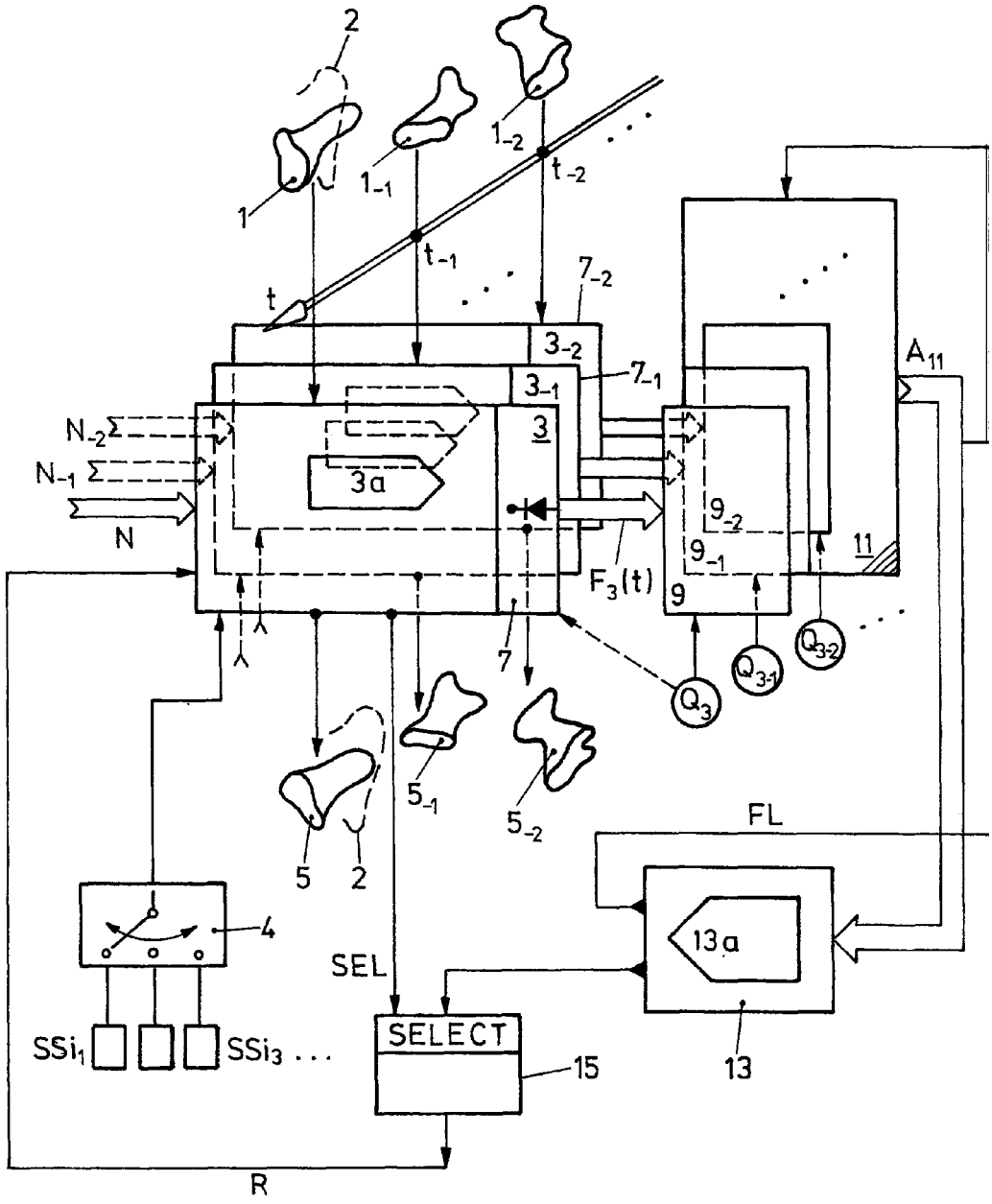
FIG. 1 by means of a schematic and simplified signal-flow/functional-block diagram, multiple adjusting-processes performed staggered in time and their mutual dependency.

The present invention shall now be described with the help of FIG. 1 which shows simplified and schematically, a signal-flow/functional-block diagram of a system according to the present invention thereby of the methods for manufacturing hearing devices.

An unfitted hearing device 1 is subjected to a momentary fitting process 3. The fitting process 3 is performed in dependency, on one hand of the unfitted hearing device 1 and e.g. its effective audiological performance on the other hand in dependency of the prevailing needs N e.g. audiological needs of the individual involved and finally in dependency of fitting conditions as of acoustical stimulus situations applied—schematically shown and selectable at $SSi_1$, to $SSi_3$ . . . in FIG. 1—fitting hard—and software available etc. Selection of appropriate acoustical stimulus situations is schematically shown in FIG. 1 by selection switch 4, which his in fact a part of the fitting process 3 and is drawn in FIG. 1 separately for clearness' sake. The momentary fitting process 3 is, as customary, performed computer—3*a*—aided in that an expert e.g. an audiologist performs computer-aided adjustment of the signal processing in the hearing device according to the prevailing needs N of the individuals. It has to be noted, that in spite of the fact the primarily addressed fitting signal processing of hearing devices and thus in fact "audiologic" fitting, mechanical as shape fitting may be performed in complete analogy.

As further customary, the result from the momentary fitting process 3, which is performed upon the unfitted hearing device 1 is a fitted hearing device 5. Thereby, the momentary fitting process 3 may be performed in-situ, —as shown in FIG. 1 in dash line at 2. In this case the individual wears the hearing device during fitting process and communicates during the fitting process either with the expert or with the fitting computer 3*a*. The fitting process may also be performed ex-situ in that the signal response of the hearing device upon audiologic stimuli SSi is monitored and is adjusted up to most closely achieve the characteristic which accords with the needs N of the individual.

According to the present invention and as shown by monitoring unit 7 the momentary fitting process 3 is monitored and its workflow is memorized in memory 9. Thereby, data which is decisive for reconstruction of the fitting process, $F_3(t)$, as e.g. significant adjustments of parameters which govern the audiological characteristics of the hearing device, possible exchanges of signal-processing units at the hearing device, the time sequence and fitting of such events is monitored and stored as the respective workflow in the memory unit 9. Besides of data identifying the mere technical workflow of the fitting process additional data as addressed above may be entered into memory unit 9. Thus in memory 9 there is memorized how the workflow of the fitting process is run through with all information data which define such fitting process to a desired accuracy and which allows reconstruction of such fitting process and of the conditions under which it was performed.

In FIG. 1 there is further represented, over the time-axis t, schematically, a sequence of subsequent fitting processes 3, $\mathbf{3}_{-1}$, $\mathbf{3}_{-2}$ etc. with respective memories 9, $\mathbf{9}_{-1}$, $\mathbf{9}_{-2}$ etc. for the fitting process workflows as performed upon unfitted hearing devices 1, $\mathbf{1}_{-1}$, $\mathbf{1}_{-2}$ etc. The fitting processes result in fitted hearing devices 5, $\mathbf{5}_{-1}$, $\mathbf{5}_{-2}$. The subsequent fitting processes may thereby have been performed on different hearing devices for different individuals and/or on different hearing devices for one individual and/or for equal hearing devices for different individuals and/or for equal hearing devices for one individual. The subsequent fitting processes 3, $\mathbf{3}_{-1}$, $\mathbf{3}_{-2}$ . . . may further have been performed at one place e.g. at one audiologist and/or at different places. Each fitting process $\mathbf{3}_{-1}$, $\mathbf{3}_{-2}$ . . . has already resulted in a memorized fitting process workflow. The memorized fitting process workflows, identifying the respective fitting processes $\mathbf{3}_1$, $\mathbf{3}_{-2}$ . . . previously performed commonly defines for a workflow databank 11, the content thereof being evaluated in a computer-aided manner in evaluation unit 13. The databank 11 is dynamically updated by respective, possibly selected, fitting process workflows. The evaluation unit 13 comprises an evaluation computer 13*a*. As was already addressed, in the respective memories 9, $\mathbf{9}_{-1}$ $\mathbf{9}_{-2}$ . . . , data additionally identifying the fitting processes may be stored e.g. identifying the expert who performed the respective fitting processes, information identifying the fitting computer which was used, the fitting software applied, the individual for which the fitting process was performed etc. The overall collected data within the memories 9, $\mathbf{9}_{-1}$, $\mathbf{9}_{-2}$ . . . and thus databank 11 is evaluated by unit 13 with the target of improving momentarily performed or future fitting processes.

As seen in FIG. 1 the result R of evaluating previously memorized fitting process workflows is operationally connected to and thus influences the momentary performed fitting process 3, which is thus, most generically, performed in dependency of previously performed fitting processes $\mathbf{3}_{-1}$, $\mathbf{3}_{-2}$ . . . . Thereby the evaluation results R are stored in result storage unit 15 and the dependency of the fitting process momentarily performed or to be performed is established from selected results as stored.

The momentary performed fitting process 3 is, as where the previously performed fitting processes $\mathbf{3}_{-1}$, $\mathbf{3}_{-2}$ . . . , monitored and the respective workflow is memorized so as to dynamically update the databank 11. The dependency of the momentary performed fitting process 3 from evaluation result R and thereby from previously performed fitting processes may be established e.g. in that a fitting process software as formerly used is updated or in that an advice is dispatched to the specialized person performing the momentary fitting process how to optimally perform such process. Such advice may e.g. be dispatched on a computer/man interface as on a computer screen of the fitting computer.

Data which may be important to qualify each of the fitting processes, the workflows thereof being memorized in the respective memories 9, $\mathbf{9}_{-1}$ . . . is quality estimate data: It may be important how the individual and/or the expert estimate a fitting process with respect to its "quality". Therefore and as shown in FIG. 1 by input data Q assigned to the respectively memorized fitting process workflows, quality estimation data is assigned to the respective fitting processes as performed. Such data Q may be entered by the involved individual at the end of or during an in-situ fitting process e.g. by having the individual scaling and entering the estimate of fitting quality. Such data may also be entered by such individual during ongoing of ex-situ fitting or after termination thereof. Such data on one hand may reflect how the involved individual is satisfied with the fitting result and may on the other hand reflect e.g. the time-span which was necessary for the addressed fitting process which may be estimated by the individual as being uncomfortably long, adequate or most satisfyingly short.

Further the qualifying data Q for a fitting process may also reflect the frequency with which the respective hearing device has or had to be recurringly re-fitted. The data Q or additional data assigned to the memorized workflows may also comprise information how the expert performing the computer-aided fitting process is satisfied with the computer aid.

Clearly the qualifying data Q assigned to a fitting process may also be estimated by the mere duration such a fitting process lasted or lasts as compared with respective different durations for same or at least similar fitting processes. In spite of the fact that the data Q is shown to be assigned to respective workflows, it is input in the frame of the fitting process 3 as shown in dash line and/or to databank 11.

The evaluation result as of R of FIG. 1 may further be used to update databank 11: If e.g. for a specific fitting process $FP_1$ evaluation of formerly performed fitting processes $FP_1$ by means of their memorized workflows reveals that one manner to perform is optimal, this optimal performing of $FP_1$ will be flagged in data base 11 as shown at FL so as to be used as the comparison basis for future $FP_1$-workflows. Thus databank 11 with evaluation is not only dynamically updated but may also be conceived as selflearning.

Figure 2:
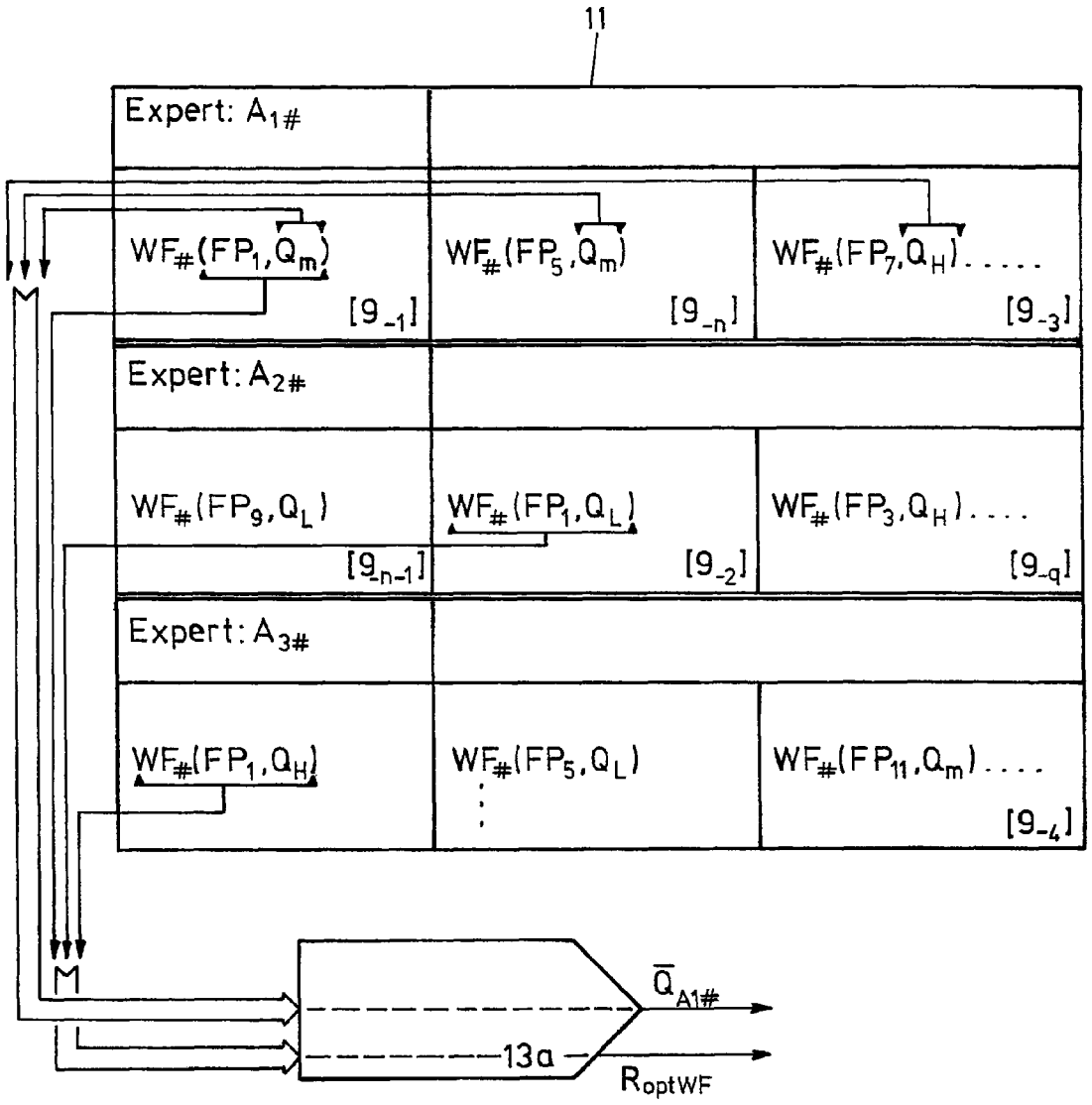
FIG. 2 most schematically and simplified an example of a data table in a databank as applied by the present invention to show some simple examples of evaluation of data within such databank.

To even more clearly establish the present invention, FIG. 2 shows merely as a highly simplified example possible data content of a fitting process workflow databank 11 as of FIG. 1 and how informative data may be evaluated and exploited to improve momentarily or future fitting processes.

According to FIG. 2 in databank 11 experts having performed the fitting processes $FP_x$, are identified by data $A_{x\#}$. The workflows $WF_\#$ are memorized in a time sequence as indicated by $\mathbf{9}_{-1}$, $\mathbf{9}_{-2}$ . . . $\mathbf{9}_{-q}$, $\mathbf{9}_{-n-1}$. To each workflow $WF_\#$ a quality estimate Q, $Q_L$ for low quality, $Q_m$ for medium and $Q_H$ for high quality, is assigned. As already addressed the workflow $WF_\#$ data comprise e.g. age and sex of the individual for which the hearing device was or is fitted, whether the fitting process $FP_x$ was performed in-situ or ex-situ, hearing diagnostic data of the individual involved as defining for hearing losses, stimulus signals which were or are used for the respective fitting process to adjust signal processing parameters, fitting software and update thereof which were used which fitting computer hardware which was used etc. etc.

As exemplified in FIG. 2 just for expert $A_{1\#}$, for each expert the quality estimates Q of the respectively performed fitting processes FP are averaged in the evaluation unit 13 by the evaluation computer 13*a* resulting in an average quality indication $\overline{Q}_{Ax\#}$ assigned to each of the experts thus for expert $A_{1x}$ the data $\overline{Q}_{A1\#}$. Thereby an indication is realized for the skill of the experts. The experts will be accordingly trained thus resulting in improved future fitting processes performed by such experts.

The respective $\overline{Q}_{Ax\#}$ value may also be an indication that an expert possibly still makes use of fitting software which should be updated.

Thus a future or momentary fitting process as of 3 of FIG. 1 which is performed by an expert will be dependent on the performance of previous fitting processes as such expert will or will not be additionally trained, his fitting computer software will or will not be updated, which is done in dependency of previously performed fitting process.

As another example which is represented in FIG. 2: It might be seen that the same or similar fitting processes $FP_1$ have been performed and have been differently estimated, low-quality $Q_L$ for expert $A_{2\#}$, high quality estimated for expert $A_{3\#}$. By reading out from the fitting process workflow databank 11 identifying data for equal or similar fitting processes as of $FP_1$ and comparing the respective quality estimate data Q, the evaluation computer 13*a* establishes which of the fitting process—$FP_1$—workflows led in an optimized manner to a desired result. Looking to the example of FIG. 2, it is established e.g. that the workflow $WF(FP_1, Q_H)$ as was performed for the fitting process $FP_1$ by the expert $A_{3\#}$ was by far more efficient and led therefore to a better quality estimate $Q_H$, than the fitting process $FP_1$ as it was performed by the expert $A_{1\#}$. Therefore, the manner how the fitting process, $FP_1$ has been performed by expert $A_{3\#}$, will be selected by the evaluation computer 13*a* to be, at the present moment, optimum and accordingly, whenever a fitting process $FP_1$ is initiated, it will be performed in dependency of the respective evaluation result $R_{optWF}$. As soon as an expert starts performing a fitting process equal or at least similar to $FP_1$ the optimum workflow as indicated by $R_{optWF}$ will be e.g. displayed at a computer/man interface to the respectively involved expert as an advice and/or the fitting computer 3*a* will be controlled to automatically lead the expert along the optimum $FP_1$-workflow.

Further, as an additional example with an eye on FIG. 2 it might be that one or the other fitting process $FP_x$ is always estimated as having a low quality $Q_L$. This may indicate that the software which is used for that fitting process $FP_x$ needs improvement. Such indication will be very helpful for the respective software manufacturer so that future fitting processes may be performed with updated software and thus again in dependency of previously performed fitting processes.

The most simple examples which have been described in context with FIG. 2 open to the skilled artisan a tremendous scope of possibilities to improve future fitting processes based on evaluation of workflows of previous fitting processes.

With an eye on FIG. 1 it has to be noted that evaluation results are stored in the result store 15, which may be incorporated in databank 11.

Whether a momentary fitting process 3 is initiated and identified, such process 3 will be made dependent from stored evaluation results which are of relevancy for the addressed fitting process.

As a simple example: if the fitting process initiated is directed on adjusting signal processing at the hearing device, then only evaluation result which are based on such signal processing fitting processes are selected to possibly influence or control the fitting process momentarily initiated.

This is schematically shown in FIG. 1 by the operational connection SEL to a select stage at result store 15.

Still with an eye on FIG. 1 the organization of the overall fitting process workflow databank 11 may be realized in different modes. Thus the respective workflow memory units 9 may be realized within respective hearing devices or within respective fitting computers 3*a* and in fact act as local intermediate or buffer memories the content thereof being copied into more centralized databank 11 or databanks 11 once such buffer memories are online with the central databank 11. The databank 11 may be established centralized e.g. at the hearing device manufacturer or at fitting centers. With an eye on the evaluation unit 13 and storage 15, it has to be noted that these units may be realized as a part of fitting computers 3*a*.

By the manufacturing and fitting methods as well as the system according to the present invention, which are primarily based on fitting process workflow storage and stored workflow evaluation, a precise analysis of fitting processes as performed becomes possible. Thereby the overall system may evaluate dynamically optimum workflows for the fitting processes and automatically build up to an expert system, the content thereof being used to lead fitting processes being performed through optimum workflows.

As the fitting process workflow databank 11 becomes regularly updated with workflow data of fitting processes, a continuous self-optimalization for the fitting processes results in a continuously updated expert system for improving future fitting processes.

Workflow evaluation further may lead to indications e.g. about software to be improved, software to be updated at certain fitting computers, experts to be trained etc.

All such actions performed as a result of previous workflow evaluation lead to future fitting process workflows being performed dependent from previous fitting process workflows and their computerized or at least computer-aided analysis or evaluation.

Dependent on the amount of workflow identifying data memorized, the evaluation process may take into account a multitude of different workflow-characteristic data leading to a highly accurate analysis and fitting process improvement. Just as an example at least a part of the following data may be incorporated in the respective fitting process workflow memories 9 of databank 11:

information about the hearing device product which was or is to be fitted;

information about audiologic or e.g. more generic medical diagnostic data of the individual to which the hearing device shall be or was fitted;

proficiency level of the fitting expert as of the audiologist and/or hearing device experience of the individual involved;

personality type of the fitting expert and/or of the individual;

mental status e.g. stress level of the fitting expert and/or of the individual involved;

fitting status of an involved hearing device, namely e.g. whether a first fitting process or a fine-fitting process which follows or followed one or more than one previous fitting processes was or is to be performed;

how is the experience, be it of the fitting expert or of the involved individual with respect to a specific hearing device. Is or was this device a new product whereabout no experience did or does exist;

are there any budget restrictions to be considered for the hearing device for an individual;

in which regional market and/or culture is the hearing device to be fitted;

which is the age of the fitting expert or of the individual involved, which may greatly influence how the fitting process is to be supported by the fitting computer;

which are the preferred acoustical surroundings of the individual involved e.g. with respect to music classes, does he prefer classical music or Heavy Rock and how does he prefer respective perception;

how is the communication quality between a specific fitting expert and the individual's he serves;

how is the confidence level which was established between the fitting expert and an individual involved as e.g. during years of mutual cooperation.

All such information may be applied for accurate definition of respective fitting process workflows as memorized.

Accordingly a very accurately differentiated evaluation may be performed on computer basis, leading also in function of self-teaching to a tremendous ability of optimizing fitting processes and thereby rising their quality level.

Figure 3:
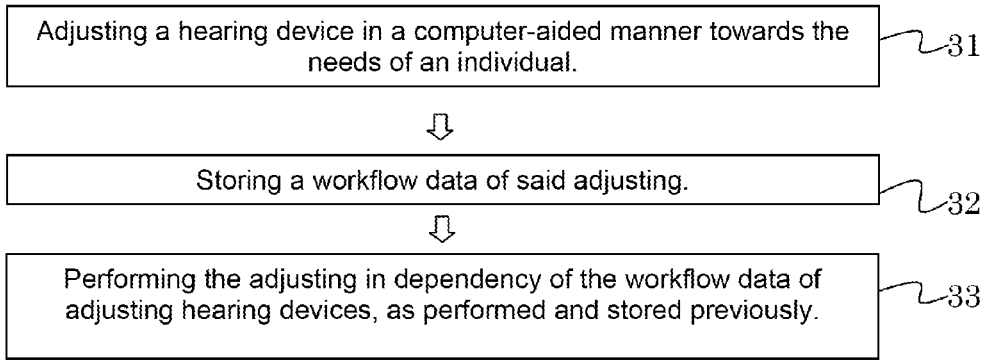
FIG. 3 Adjusting a hearing device in a computer-aided manner towards the needs of an individual, and storing a workflow data of the adjusting. The workflow may include, one or more of, adjusting steps or fitting operations, a timing of performing of the adjusting steps or fitting operations, or a time sequence of the adjusting steps or fitting operations. The adjusting may be performed in dependency of said workflow data of adjusting hearing devices, as performed and stored previously.

FIG. 3 describes a method for manufacturing a hearing device which is fitted to needs of an individual which comprises adjusting the hearing device in a computer-aided manner towards the needs of an individual; 32 storing a workflow data of the adjusting; 33 and performing the adjusting in dependency of said workflow data of adjusting hearing devices, as performed and stored previously. 34

The invention claimed is:

1. A method for fitting a hearing device to needs of an individual, comprising:

adjusting said hearing device in a computer-aided manner towards said needs of said individual;

storing a workflow data of said adjusting, said workflow data comprising at least one of:

one or more adjusting steps or fitting operations, a timing of performing of the adjusting steps or fitting operations, and a time sequence of the adjusting steps or fitting operations;

performing said adjusting in dependency of said workflow data of adjusting hearing devices, as performed and stored previously.

2. The method of claim 1, wherein said adjusting comprises adjusting signal processing at said hearing device.

3. The method of claim 1, wherein said stored workflow data further comprises at least one of:

data identifying a particular workflow;

a fitting expert performing said adjusting;

said individual;

software for said computer-aided adjusting;

hardware for said computer-aided adjusting;

hardware of said hearing device;

software of said hearing device;

conditions whereupon said adjusting is performed; and quality estimate of said adjusting.

4. The method of claim 1, wherein said adjusting in dependency is established via computer-aided evaluation of at least a part of said stored workflow data.

5. The method of claim 1, wherein establishing said adjusting in dependency, comprises at least one of:

consulting and/or training an expert performing said adjusting in dependency of at least a part of said stored workflow data;

updating or rebuilding software for said computer-aided adjusting in dependency of at least a part of said stored workflow data;

optimizing workflows for said adjusting in dependency of at least a part of said stored workflow data.

6. The method of claim 1, further comprising storing results of an evaluation of at least a part of said stored workflow data and basing future evaluations on said stored results.

7. The method of claim 1, further comprising providing said workflow data in at least one databank.

8. The method of claim 1, further comprising:

selecting, in dependency of said adjusting to be performed, a subset of data of said stored workflow data.

9. A fitting system for fitting hearing devices towards needs of respective individuals, comprising:

a fitting computer; and a workflow databank, wherein a data input of said workflow databank being operationally connectable to a data output of said fitting computer, wherein said fitting computer generates, at said output, a workflow data identifying a fitting operation workflow, said workflow data comprising at least one of:

one or more adjusting steps or fitting operations, a timing of performing of the adjusting steps or fitting operations, and a time sequence of the adjusting steps or fitting operations, wherein an output of the workflow databank is operationally connected to an input of an evaluation unit, an output of said evaluation unit operationally acting on at least one of:

a computer/man interface adjacent said fitting computer and said fitting computer.

10. The system of claim 9, wherein said evaluation unit is remote from or integrated in said fitting computer.

11. A method for fitting a hearing device to needs of an individual, comprising:

adjusting said hearing device in a computer-aided manner towards said needs of said individual, wherein said adjusting said hearing device comprises: adjusting signal processing at said hearing device;

storing a workflow data of said adjusting, said workflow data comprising at least one of:

one or more adjusting steps or fitting operations;

a timing of performing of the adjusting steps or fitting operations; and a time sequence of the adjusting steps or fitting operations; and performing said adjusting in dependency of said workflow data of adjusting hearing devices, as performed previously.

* * * * *